US012048339B2

(12) United States Patent
Gray

(10) Patent No.: US 12,048,339 B2
(45) Date of Patent: Jul. 30, 2024

(54) GARMENT FOR PATIENTS RECEIVING TREATMENT

(71) Applicant: Cassandra Gray, Irvine, CA (US)

(72) Inventor: Cassandra Gray, Irvine, CA (US)

( * ) Notice: Subject to any disclaimer, the term of this patent is extended or adjusted under 35 U.S.C. 154(b) by 0 days.

(21) Appl. No.: 17/752,358

(22) Filed: May 24, 2022

(65) Prior Publication Data

US 2022/0369730 A1 Nov. 24, 2022

Related U.S. Application Data

(60) Provisional application No. 63/192,365, filed on May 24, 2021.

(51) Int. Cl.

| | |
|---|---|
| ***A41D 13/005*** | (2006.01) |
| ***A41D 13/12*** | (2006.01) |
| ***A41D 27/02*** | (2006.01) |
| ***A41D 27/10*** | (2006.01) |

(52) U.S. Cl.

CPC ..... *A41D 13/0051* (2013.01); *A41D 13/0058* (2013.01); *A41D 13/1245* (2013.01); *A41D 27/02* (2013.01); *A41D 27/10* (2013.01); *A41D 2200/20* (2013.01); *A41D 2300/324* (2013.01)

(58) Field of Classification Search

CPC ..... A41D 13/1245; A41D 27/10; A41D 13/0051; A41D 13/0058; A41D 13/0012; A41D 27/02; A41D 13/1236; A41D 13/1263; A41D 13/1281; A41D 13/129; A41D 1/02; A41D 3/02; A41D 2300/324; A41D 2300/322; A41D 2200/20

USPC ..... 2/114, 70, 125

See application file for complete search history.

(56) References Cited

U.S. PATENT DOCUMENTS

| | | | | |
|---|---|---|---|---|
| 1,152,169 | A * | 8/1915 | Goldman | A41D 1/02 2/93 |
| 4,087,864 | A | 5/1978 | LaBove | |
| 6,018,819 | A | 2/2000 | King et al. | |
| D457,290 | S * | 5/2002 | Thompson | D2/743 |
| 7,230,206 | B1 | 6/2007 | Randall | |
| 7,244,914 | B2 | 7/2007 | Yoneyama et al. | |
| 7,375,308 | B2 | 5/2008 | Ferguson | |
| 8,607,366 | B2 | 12/2013 | Austin | |

(Continued)

FOREIGN PATENT DOCUMENTS

| | | | |
|---|---|---|---|
| KR | 20080000078 U | * | 1/2008 |
| KR | 200477334 Y1 | * | 6/2015 |
| KR | 101588166 B1 | * | 1/2016 |

OTHER PUBLICATIONS

English language translation of KR-101588166-B1 (Park); Doc Pub. Jan. 2016 (Year: 2016).*

*Primary Examiner* — Amy Vanatta

(74) *Attorney, Agent, or Firm* — Fitzpatrick PC; William Fitzpatrick

(57) ABSTRACT

A garment for patients receiving medical treatment is disclosed. The garment has a sleeve that has an outer surface and an inner surface each made of a first material, a fastener coupled to the sleeve and configured to open and close the sleeve, an inner lining attached to the inner surface of the sleeve. The inner lining is made of a second material that has a higher elasticity than the first material. The garment has a series of pockets disposed on the inner lining configured to hold a heating element to keep the patient's arms warm while in the treatment position.

20 Claims, 11 Drawing Sheets

(56) References Cited

U.S. PATENT DOCUMENTS

| | | | | |
|---|---|---|---|---|
| 2006/0053525 | A1* | 3/2006 | Legard | A41D 13/1245 2/114 |
| 2006/0277653 | A1* | 12/2006 | Okajima | A41D 3/00 2/93 |
| 2007/0095808 | A1 | 5/2007 | Lacy, III | |
| 2007/0101478 | A1 | 5/2007 | Koscheyev et al. | |
| 2008/0023460 | A1 | 1/2008 | Huang | |
| 2008/0040831 | A1 | 2/2008 | Nilforushan | |
| 2008/0067163 | A1 | 3/2008 | Axinte et al. | |
| 2008/0083720 | A1 | 4/2008 | Gentile et al. | |
| 2008/0083721 | A1 | 4/2008 | Kaiserman et al. | |
| 2008/0093354 | A1 | 4/2008 | Fang et al. | |
| 2008/0116189 | A1 | 5/2008 | Fernandez et al. | |
| 2009/0184106 | A1 | 7/2009 | Wu | |
| 2009/0289046 | A1 | 11/2009 | Richmond | |
| 2016/0199576 | A1 | 7/2016 | Savage | |
| 2016/0286872 | A1* | 10/2016 | Wilson | A41D 13/0058 |
| 2016/0309811 | A1* | 10/2016 | Tong | A41D 13/1245 |
| 2018/0078408 | A1* | 3/2018 | Nilforushan | A61F 7/02 |
| 2018/0295912 | A1* | 10/2018 | Watts | A41D 13/0058 |
| 2019/0059472 | A1* | 2/2019 | Hopkins | A41D 1/04 |
| 2020/0214372 | A1* | 7/2020 | Lindsey | A41D 13/1245 |
| 2021/0052025 | A1* | 2/2021 | Colon-Alfonso | A41D 27/10 |
| 2021/0127765 | A1* | 5/2021 | Thompson, Jr. | A41D 13/1245 |
| 2021/0212394 | A1* | 7/2021 | Wu | A41D 13/1245 |
| 2021/0274858 | A1 | 9/2021 | Garramone | |

* cited by examiner

GARMENT FOR PATIENTS RECEIVING TREATMENT

CROSS-REFERENCE TO RELATED APPLICATIONS

This application claims the benefit of U.S. Provisional Patent Application Ser. No. 63/192,365 filed May 24, 2021, entitled Garment for Patients Receiving Treatment, the entire contents of which are incorporated by reference herein for all purposes.

FIELD OF THE INVENTION

The present invention generally relates to upper body garments for an individual. More specifically, the present invention relates to garments worn by patients undergoing certain treatments (e.g., medical or medicinal) to keep the patient warm and comfortable during treatment, and further, providing for access sites for infusions and other treatments that require access to the patient's skin (e.g., blood pressure measurements).

BACKGROUND

Many patients receive intravenous treatments and therapies to administer medications or use intravenous treatment for other medical therapies such as blood transfusions, chemotherapy treatments, and correction of electrolyte imbalances, etc. Additionally, these treatments are used to provide nutrition to patients who cannot consume food and/or water through the mouth. As it is generally considered to be the fastest and safest way to deliver medications and replace fluids throughout the body, a great number of people undergo such intravenous treatments and therapies. In most cases, in order to administer the intravenous treatment or therapies, patients are required to disrobe and take their arms out of their sleeves, which causes the patient to feel uncomfortably cold while they are receiving these treatments.

While undergoing intravenous treatments or therapies, it is necessary that the patient's body temperature be regulated. There have been various developments, including medical gowns, used to warm the patient's body to achieve temperature regulation, which is needed for medical treatments and therapies, however, these developments fail to keep the patient warm during the course of the treatment. With these developments, the patient remains uncomfortably cold throughout the course of the treatment.

Typically, a patient undergoing such treatments must either wear a hospital gown or a shirt with short sleeves to provide access to the arms for connection of tubes and other devices used in the treatment. Further, throughout the entire process of administering such treatment, the patient must keep the access area to his or her arms uncovered so that the attendant monitoring the patient can always check the connections without interruption, to ensure no loss of medication, treatment or blood.

However, the various gowns that are currently available, including different types of blankets, heating pads, and hot packs used to keep the patients warm may cover the entire access area to the patient's arms, thus disturbing the infusions and other connected devices, or may function such that they can only cover certain parts of the body thereby leaving other parts of the patient's body to feel cold. Thus, there are many problems associated with the existing warming garments in assisting such medical conditions and procedures.

For example, hospital garments exist, which assists in connecting catheters to the body. U.S. Pat. No. 8,607,366B2 to Austin describes a garment having a vertical opening and a transverse flap on the front panel thereof for securing an external portion of a central line or catheter having at least two distal lumens or branches. The external portion of the catheter extends through a gap between a pair fasteners of the vertical opening. In order to secure the catheter, the flap includes a stopper that is fastened to front panel such that the stopper is located between the distal branches of the catheter. If one or both of the distal branches are pulled or tugged, a junction or transition area of the catheter is pressed against the stopper and limits further motion of the catheter to prevent dislodgement thereof. The flap further includes a series of fasteners for releasably coupling a free edge thereof onto the front panel to house the external portion of the catheter under the closed flap.

However, even these types of specialty garments do not focus on procedures that require access to a patient's arm(s) and do not sufficiently regulate the patient's temperature by keeping the patient warm or providing adequate/easy access to the skin/limbs.

In light of the above-mentioned drawbacks, there is a need for a body warming garment that takes these treatments into consideration and which keeps the patient warm and comfortable during such treatment while simultaneously providing the patient's medical staff with easy access to the patient's arms.

SUMMARY OF THE INVENTION

The present invention generally discloses a medical garment to cover the upper body of an individual. Further, the present invention discloses garments worn by patients undergoing certain medical treatments to keep the patient warm and comfortable during treatment, having access sites for infusions and other treatments that require access to the patient's skin (e.g., blood pressure measurements).

In one embodiment, the garment is a medical garment worn by patients undergoing certain medical treatments to keep the patient warm and comfortable during treatment. The garment covers the upper body of the patient wearing the garment. In one embodiment, the garment is made of soft and flexible fabric. In some embodiments, the garment is made from a warm, soft material such as a woven cotton material or jersey. In one embodiment, the garment has embodiments that are directed to males, females, and both.

In an embodiment, the garment comprises a body portion configured to cover the patient's upper body; an openable and closeable sleeve coupled to the body portion, wherein the sleeve has an outer surface and an inner surface each made of a first material, wherein the arm sleeves are configured to cover an arm of the patient; a fastener coupled to the sleeve and configured to open and close the sleeve, wherein an open configuration is a treatment position and an inner lining attached to the inner surface of the sleeve, wherein the inner lining is made of a second material that has a higher elasticity than the first material, and wherein the inner lining is configured to further cover the arm of the patient; and a series of pockets disposed on the inner lining, wherein at least one of the series of pockets are configured to hold a heating element to keep the patient's arms warm while in the treatment position.

In embodiments, a method for accessing an arm of a person receiving treatment is provided. The method comprises providing a garment comprising a body portion configured to cover the patient's upper body, an openable and closeable/resealable sleeve coupled to the body portion, wherein the sleeve has an outer surface and an inner surface each made of a first material, wherein the arm sleeves are configured to cover an arm of the patient, a fastener coupled to the sleeve and configured to open and close the sleeve, wherein an open configuration is a treatment position, an inner lining attached to the inner surface of the sleeve, wherein the inner lining is made of a second material that has a higher elasticity than the first material, and wherein the inner lining is configured to further cover the arm of the patient, and a series of pockets disposed on the inner lining, wherein at least one of the series of pockets are configured to hold a heating element to keep the patient's arms warm while in the treatment position; opening sleeve using the fastener, stretching the inner liner to access an arm of the patient, inserting heating elements into the pockets, performing a procedure on the patient, allowing the inner liner to contract to keep the patient's arm warm.

In one embodiment, the garment comprises a body portion to cover the upper body of the patient. The body portion has an openable and closable/resealable opening disposed in a front portion thereof and may extend along the entire length of the body portion. In one embodiment, the closable opening is fastened using at least one fastener but may also be multiple fasteners. In one embodiment, the fastener is a zipper. In other embodiments, the fastener may be, but is not limited to, snap buttons, magnets and magnet strips, self-adhering fabric, and hook and loop (Velcro®) fasteners, snap Fasteners, hook and eye Fasteners, tie closures, frog closures, toggle fasteners and the like.

In one embodiment, the garment further comprises a pair of arm sleeves including a left arm sleeve and a right arm sleeve. The arm sleeves are sewed to the body portion to cover the arms of the patient or are manufactured as a one piece garment. In one embodiment, the left arm sleeve has a first openable and closable arm opening that extends the entire length of the left arm sleeve from an outer bottom cuff to a left shoulder line but may be shorter in other embodiments. In one embodiment, the right arm sleeve has a second openable and closable arm opening extending the entire length of the right arm sleeve from an outer bottom cuff to a right shoulder line but may be shorter in other embodiments.

The openable and closable arm openings allow the arm to be exposed for a large blood pressure cuff to be put on the arm without the arm sleeves getting in the way during treatment or receive an intravenous fluid drip, but an inner layer is provided to ensure patient warmth during procedures. In one embodiment, the garment further comprises one or more access sites on the inner layer for infusion of any tubes or wires that are part of the treatment. The garment further comprises one or more flaps that protect the skin from the fasteners to ensure comfort.

In one embodiment, the arm sleeve of the garment may fit around the arm of the user. In one embodiment, the sleeve includes an inner lining made of thermal fabric material for keeping the user warm while receiving treatment, the inner lining being dimensioned to allow the sleeve to increase its diameter when the fasteners are undone during the treatment phase.

In one embodiment, the sleeve, inner lining or both has one or more internal pockets or connection sites for thermal elements described more fully below. In embodiments, the lining runs the entire length arm sleeve with pockets sewn into the inner lining, inside of the sleeve, or both.

In one embodiment, the pockets are dimensioned to hold internal heating elements to keep the patient's arms warm while receiving treatment. The heating elements may comprise, for example, plug-in or battery-operated heating elements along with self-heating or manually heating elements. Self-heating elements or manual heating elements may comprise disposable warmers that use exothermic reactions containing iron powder, salt, water, an absorbent material, and activated carbon generally.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

Figure 1:
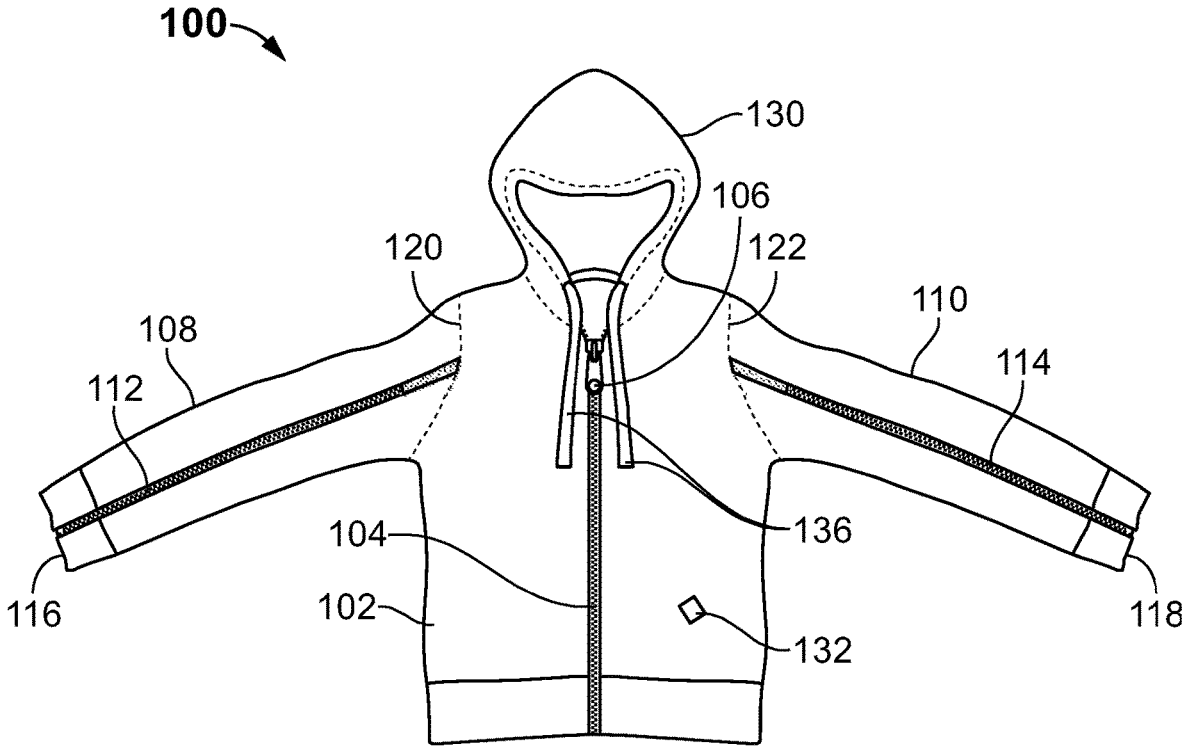
FIG. 1 shows a front view of a garment for receiving treatment in one embodiment of the present invention.

The present invention is best understood by reference to the detailed figures and description set forth herein.

It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Embodiments of the system are discussed below with reference to the examples. However, those skilled in the art will readily appreciate that the detailed description given herein with respect to these examples is for explanatory purposes as the system extends beyond these limited embodiments. For example, it should be appreciated that those skilled in the art will, in light of the teachings of the present system, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the system that are too numerous to be listed but that all fit within the scope of the system. Also, singular words should be read as plural and vice versa and masculine as feminine and vice versa, where appropriate, and alternative embodiments do not necessarily imply that the two are mutually exclusive.

It is to be further understood that the present system is not limited to the particular methodology, compounds, materials, manufacturing techniques, uses, and applications, described herein, as these may vary. It is also to be understood that the terminology used herein is used for the purpose of describing particular embodiments only and is not intended to limit the scope of the present system. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this system belongs. Preferred methods, techniques, devices, and materials are described, although any methods, techniques, devices, or materials similar or equivalent to those described herein may be used in the practice or testing of the present system.

As used herein, a "patient" is a user or wearer of the garment, and while the garment is directed toward a patient receiving intravenous fluids, it is useful for other types procedures or occasions in which the user desires to be kept warm and access to the user's arm is needed.

Referring to FIG. 1, a front view of a garment 100 for patients receiving medical or medicinal treatment according to one embodiment of the present invention. In one embodiment, the garment 100 is a medical garment worn by patients undergoing certain treatments to keep the patient warm and comfortable during treatment. The garment 100 covers the upper body of the patient wearing the garment. In one embodiment, the garment 100 is manufactured or made of soft and flexible fabric and from a warm, soft material such as a woven cotton material or jersey.

The garment 100 comprises a body portion 102 configured to cover the upper body of the patient and comprises an openable and closable/resealable opening 104 in a front portion of the arms but may be on other portions as well (e.g., side, back). The openable and closable/resealable opening 104 extends along the entire length of the body portion 102 and is openable and closable/resealable via a fastener 106 such as a zipper. The sleeve has an outer surface and an inner surface each made of a first material that is different than the material of the internal layer (second material to be discussed with reference to FIG. 2).

However, the garment may also be a long sleeve shirt or a sweatshirt with non-zip up front. In one embodiment, the fastener 106 is a zipper. In other embodiments, the fastener 106 may be, snap buttons, magnets, self-adhering fabric, hook, and loop (Velcro®) fasteners, wrap-around fastener, and the like. In other embodiments, the garment may not have a front zipper, may be a pull-over or a button shirt or flannel-type shirt. In this embodiment, the garment may comprise a plurality of ports or opening that may be disposed on a chest portion or on another portion thereof.

The garment 100 further comprises a pair of arm sleeves including a left arm sleeve 108 and a right arm sleeve 110. The arm sleeves 108 and 110 are coupled to the body portion 102 to cover the arms of the patient. The left arm sleeve 108 has a first openable and closeable/resealable arm opening 112 extending the entire length of the left arm sleeve 108 from an outer bottom cuff 116 to a left shoulder line 120. Because the closures run both up and down the sleeve via two zippers, the IV tube does not have to run down the arm, but may port out of a hole between two zippers or two closures that surround the tube so that the heat stays in the patient's body while the internal fabric layer is provided to warm the patient as well. Similarly, the right arm sleeve 110 has a second openable and closeable arm opening 114 extending the entire length of the right arm sleeve 110 from an outer bottom cuff 118 to a right shoulder line 122. Each of the sleeve and the openable and closeable/resealable openings 112 and 114 are fastened together using a fastener 128 or a series of fasteners (shown in FIG. 2). Again, because the closures run both up and down the sleeve via two zippers or closures, a tube does not have to run down the arm, but may port out a hole between two zippers or closures that surround the tube so that the heat stays in the patient's body and the internal layers keep the patient warm. Further, in embodiments, no port may be required at all due to the elastic nature of the inner layer to be discussed with relation to FIG. 2.

In one embodiment, the arm sleeves 108 and 110 may be raglan sleeves and may extend over the shoulder without being stopped by the shoulder lines 120 and 122. The openable and closeable arm openings 112 and 114 allow internal layer (shown in FIG. 2) to be fully exposed so that a physician or treatment provider can access the upper portion of arm for a blood pressure cuff to be put on the arm without the arm sleeves (108 and 110) getting in the way during treatment or have access to the veins required for an IV treatment. In one embodiment, the garment 100 further comprises one or more access sites on the inner layer for infusion of any tubes or wires that are part of the treatment. In this way, the garment has three positions: a closed position as shown in FIG. 1 and, open or treatment position to access the arm, and a partially close position in which the dual zippers are shut during treatment but for a port as shown in FIG. 2.

With reference still to FIG. 1, in one embodiment, the garment 100 further comprises a hood 130 coupled to the upper end of the body portion 102 to cover the patient's head. In one embodiment, the hood 130 has a drawstring 136. The drawstring 136 is inserted into a through-hole in the front edge of the hood 130. The drawstring 136 is adjustably positioned to provide comfort to the patient while wearing the garment 100 during treatment. The hood 130 may also comprise heating element pockets or heating elements may be sewn in.

Figure 2:
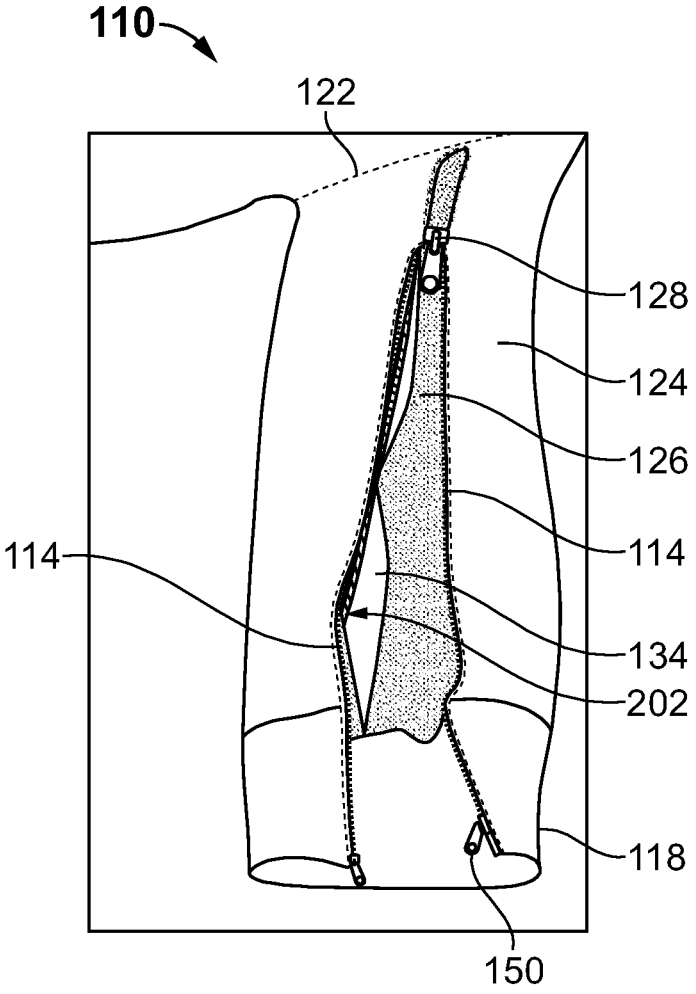
FIG. 2 shows a perspective view of an arm sleeve of the garment in an open or treatment position in one embodiment of the present invention.

Referring now to FIG. 2, a perspective view of an arm sleeve 110 in an open or treatment position according to one embodiment of the present invention is shown. In one embodiment, the arm sleeve 110 has an outer surface 124 and an inner lining 126 coupled to an inner surface 202 of the sleeve (via sewing or other attachment) at least two points allowing for a port hole, or in the embodiment in which the inner layer opens up entirely with the zipper along with the outer arm to port out the zipper. The inner lining 126 may be manufactured using a thermal fabric material but may also be any useful material such as an elastic material. In embodiments, an elastic thermal fabric may be used so that the treating clinician has easy access to the patient's (or user's) arm. In this embodiment, the arm zippers 128 may be a garment zipper 106 comprising two-way zippers 150 positioned close to the cuff and are configured to close into each. In one embodiment, the arm sleeves (108 and 110) are completely open to expose the arm and give access to the arm for an IV treatment, then the two-way zippers are closed after insertion of the IV and the IV ports our the hole created by the zippers. In another embodiment, inner layer 126 is does not open up with the zipper and access to the arm is achieved by the user or clinician pulling up the elastic portion to access the arm, or via a port on the inner layer 126 to allow the IV tube or other treatment faculties (e.g., tubes) to rest against the user's arm or inner layer with the terminal end leaving the user at the cuff if there is no port, or via the port if the garment has a port in the inner layer 126. As described above, in operation, the opening arm sleeves allow the medical personnel to perform blood pressure and other tests without removing the garment or to insert a needle/IV into any part of the exposed arm, while also utilizing the inner thermal layer to keep that part of the patient's body warm during treatments.

Figure 3:
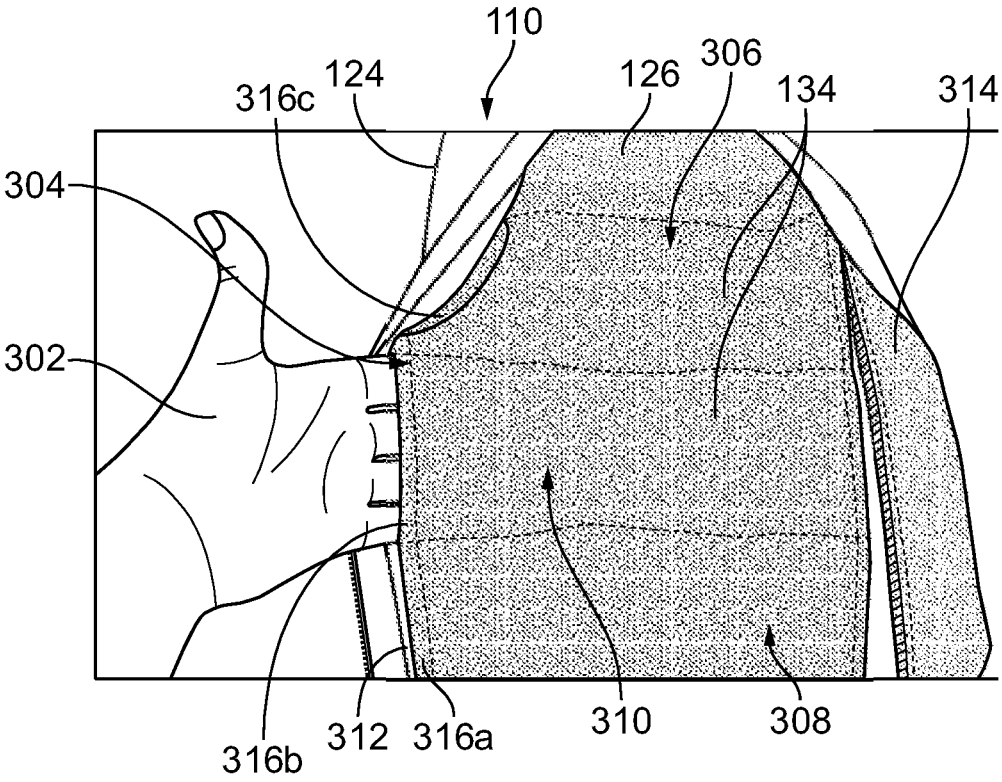
FIG. 3 shows an inner view of the arm sleeve and internal pockets of the garment in one embodiment of the present invention.

Referring now to FIG. 3, an inner view of an arm sleeve 110 of the garment 100 is shown in one embodiment of the present invention. The arm sleeve 110 of the garment 100 may fit around the arm of the user and like as shown in FIG. 2, comprises the inner lining 126 made of thermal elastic fabric material for keeping the user warm while receiving treatments. In one embodiment, the thermal elastic fabric is dimensioned so that the sleeve can diametrically expand when in the open or treatment position due to a predetermined additional amount of fabric and/or the elasticity of the fabric. In another embodiment, the inner layer opens via the two-way zipper together with the outer layer.

In one embodiment, the sleeve 110 has an attached inner lining 126 such that it forms a series of pockets 304*a*, 304*b* and 304*c* (n+1) that rest between the inner portion of the sleeve 110 and the inner lining 126. For perspective, a left-hand inner portion 314 of the sleeve shown. The pockets as shown comprise a plurality of pockets 134. A user's hand 302 is shown for perspective and to further show how the pockets open on a side portion to reveal the plurality of pockets 134. In embodiments, the pockets may be sealed on every other seam so that pockets are available for use in every other seem closure in a close, open, closed arrangement. In operation, the pockets 134 are dimensioned to fit heating elements that may be mechanical or electrical in nature. These small heaters may be placed in the pockets by the user depending on where the IV is inserted in the arm. Also, in other embodiments, the garment 100 may comprise hand portions that roll out from the sleeve and may also comprise internal pockets to warm the user's hand.

Figure 7:
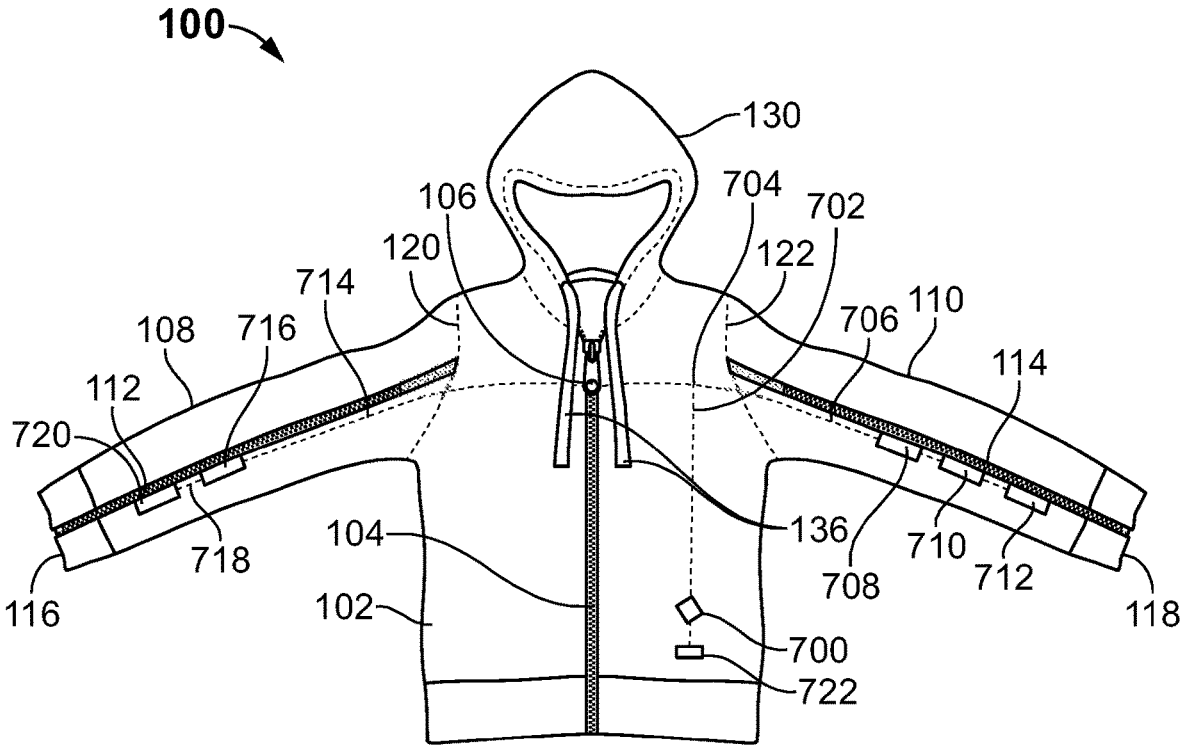
FIG. 7 shows a front view of a garment's internal electronics for receiving treatment in one embodiment of the present invention.

In one embodiment, the pockets 134 (comprising 306, 308, 310) are disposed in the lining 126 of the arm sleeves (108 and 110) and are configured to hold heating elements and keep the patient's arms warm while receiving treatments. In other embodiments, as shown in FIG. 7, the heating elements may be powered by battery (e.g., lithium-ion rechargeable batteries) or in other embodiments, be disposable self-heating elements that create an exothermic reaction upon the appliance of motion or pressure, or may be liquid heating elements such as self-heating or manual heating elements. The heating elements warm the patient's body during treatment.

In embodiments, each pocket or pouch 306, 308, 310 comprise an additional thermal fabric material to act as a flap 316*a*, 316*b* and 316*c* to hold the heating elements inside the pockets during treatment while also being configured to allow the user or clinician to easily input and remove the heating elements. While in some embodiments a flap may be used, each pocket 306, 308, 310 comprise its own opening and closing mechanism internally such as hook and loop, flat magnets and the like. Again, in this way, the heating elements can easily be changed out by the user or the clinician before, during and/or after treatment.

Figure 4:
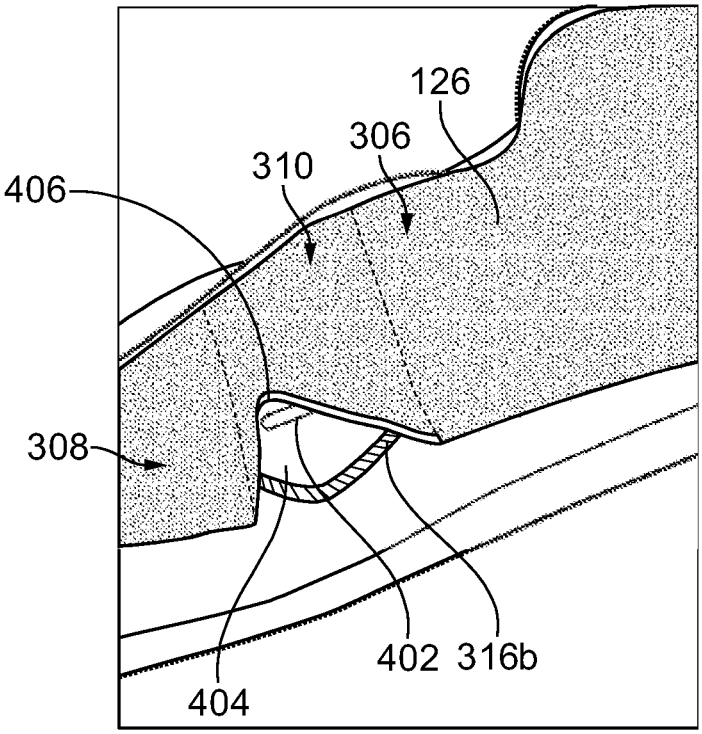
FIG. 4 shows a perspective view of the arm sleeve and internal pocket in the open position in one embodiment of the present invention.

Referring now to FIG. 4, a perspective view of the arm sleeve (108, 110), inner sleeve 126, and pockets 306, 308 and 310 shown in the open position is shown. For perspective pockets 306, 308, 310 are shown. As shown, pocket 310 is shown in the open position so that the user or the clinician can either insert or remove heating elements. Additional thermal fabric material act as a flap 316*a*, 316*b* and 316*c* to hold the heating elements 402 inside the pockets during treatment while also being configured to allow the user or clinician to easily insert and remove the heating elements 402. An internal area 402 of the pocket 310 is shown as is flap 316*b* which envelops an edge 406 of the pocket 310 when in the closed position when the garment is in use.

Figure 5:
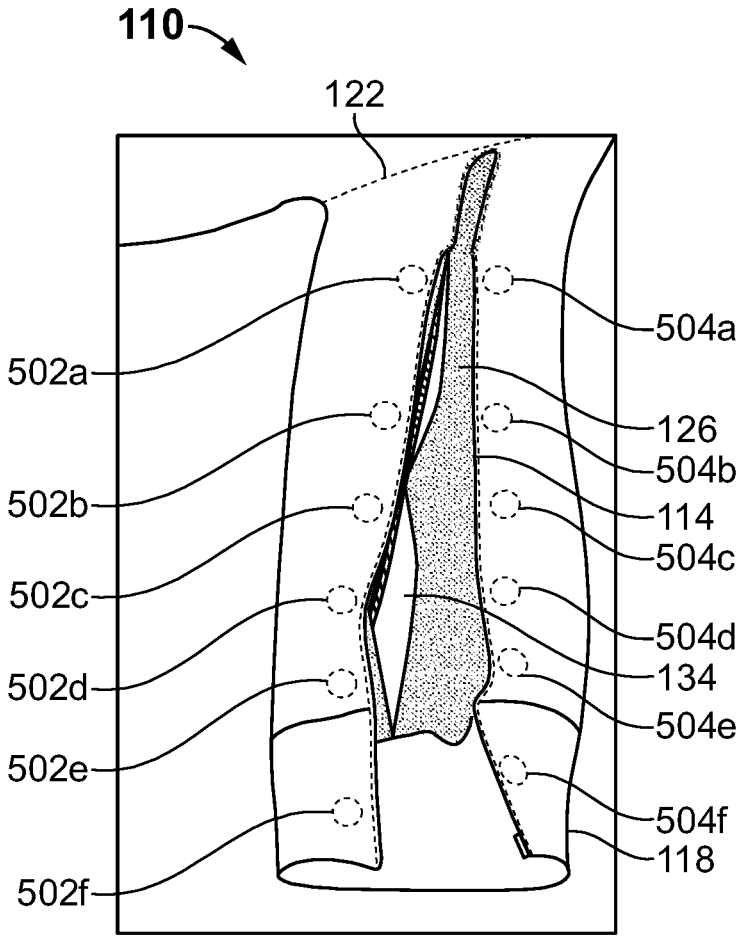
FIG. 5 shows a perspective view of an arm sleeve of the garment in an open or treatment position in one embodiment of the present invention.

Referring now to FIG. 5, an optional embodiment in which each of the sleeves comprise magnets as the opening and closing mechanisms. For perspective the arm sleeve 110 is shown with the outer surface 124 and an inner lining 126 coupled to an inner surface 202 of the sleeve (via sewing or other attachment). Like with relation to FIG. 1 and FIG. 2, the inner lining 126 may be manufactured using a thermal fabric material but may also be any useful material. In embodiments, an elastic thermal fabric may be used so that the treating clinician has easy access to the patient's (or user's) arm. In this embodiment, the arm is openable and closable using a plurality of magnets 502*a-f* and 504*a-f*. The magnet (or magnet strips) comprises elements that produce a magnetic field, such as permanent magnets having a opposite polarities and may comprise a "north pole" magnet 502*a-f*, and "south pole" magnets 504*a-f*, or vice versa. The magnets produce their own magnetic field, and further respond to magnetic fields. In operation, the magnets 502*a-f* and 504*a-f* are configured having a magnetic field that is strong enough to keep the arm sleeve 124 together but also weak enough to allow the user or clinician to pull the sleeve open while using low to moderate force.

In this way, the magnets are used to expose inner layer 126 and give access to the arm for treatment via the user or clinician pulling up the elastic portion to access the arm, or via a port on the inner layer 126 to allow the IV tube or other treatment faculties (e.g., tubes) to rest against the patient or user's arm or inner layer with the terminal end leaving the garment at the cuff if there is no port, or via the port if the garment has a port in the inner layer 126. As described above, in operation, the opening arm sleeves allow the medical personnel to perform blood pressure and other tests without removing the garment or to insert a needle/IV into any part of the exposed arm, while also utilizing the inner thermal layer to keep that part of the patient's body warm during treatments.

Figure 6:
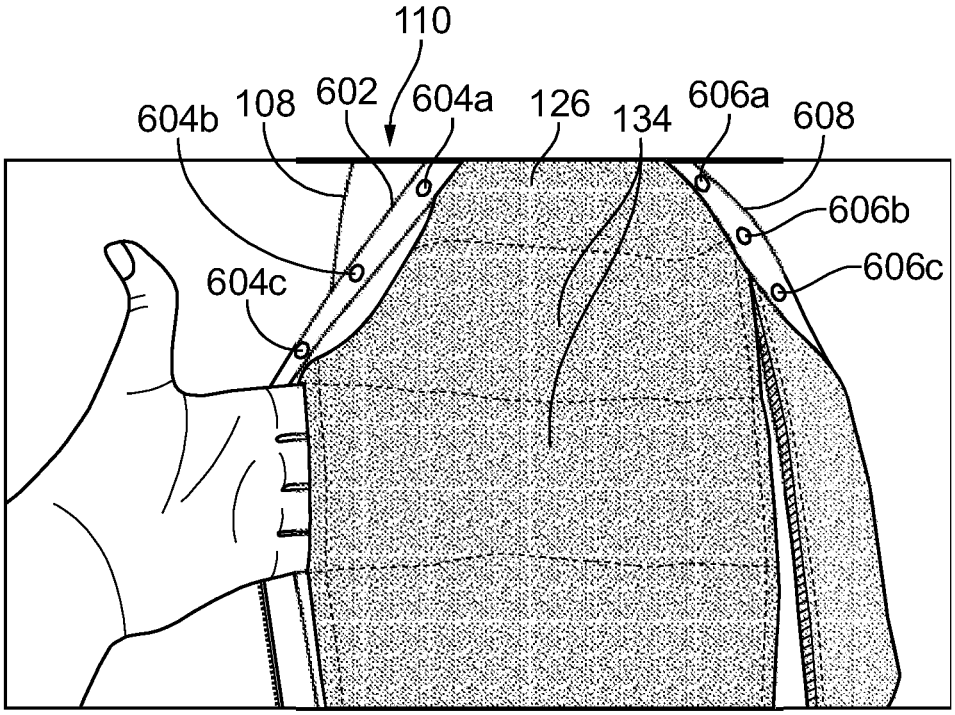
FIG. 6 shows an inner view of the arm sleeve and internal pockets of the garment in one embodiment of the present invention.

Referring now to FIG. 6, an optional embodiment in which each of the sleeves comprise miniature magnets 604*a-c* and 606*a-c* that are positioned facing each other sewn into the side portion 602 of each sleeve (but not on inner portion 608) at the opening and closure sections. Like with FIG. 6, the arm is openable and closable/resealable using a plurality of magnets 604*a-c* and 606*a-c* and has elements that produce a magnetic field, such as permanent magnets having opposite polarities and may comprise a "north pole" magnet 604*a-c*, and "south pole" magnet 606*a-c*, or vice versa.

In this way, the magnets are used to expose inner layer 126 and give access to the arm for treatment via the user or clinician pulling up the elastic portion to access the arm, or via a port on the inner layer 126 to allow the IV tube or other treatment faculties (e.g., tubes) to rest against the user's arm or inner layer with the terminal end leaving the garment at the cuff if there is no port, or via the port if the garment has a port in the inner layer 126. As described above, in operation, the opening arm sleeves allow the medical personnel to perform blood pressure and other tests without removing the garment or to insert a needle/IV into any part of the exposed arm, while also utilizing the inner thermal layer to keep that part of the patient's body warm during treatments.

Referring now to FIG. 7, a front view of an optional embodiment in which the heating elements are connected to internal electronics is shown. For perspective with relation to FIG. 1, the body portion 102 is shown with the openable and closable/resealable opening 104 a pair of arm sleeves including a left arm sleeve 108 and a right arm sleeve 110 with openable and closeable/resealable arm opening 112 extending the entire length of the left arm sleeve 108 from an outer bottom cuff 116 to a left shoulder line 120.

In this embodiment, a microcontroller 700 having a battery is provided and is electrically connected to a charging port 722. The microcontroller is electrically connected via line 702 and branches at branch 702 to each of the sleeves 108 and 110. The electrical connection is configured to input signals to internal heating elements 708 and 710 via line 706 in the left-hand sleeve and 716 and 718 via line 714 in the right-hand sleeve. Additional heat elements 712 and 720 may be provided as well. The microcontroller may be configured to automatically turn the heating elements on when either of the sleeves are in the open position based on a signal from a sleeve sensor. In this way, in operation, the garment recognizes when a procedure is about to be performed and heats the internal heating elements to an optimized temperature so the user remains warm. In embodiments, the microcontroller is wireless and is configured to communicate with the heating elements in a wireless manner. The heating elements have their own processors and communication protocol in this embodiment so that they can be controlled wirelessly by the controller.

Figure 8:
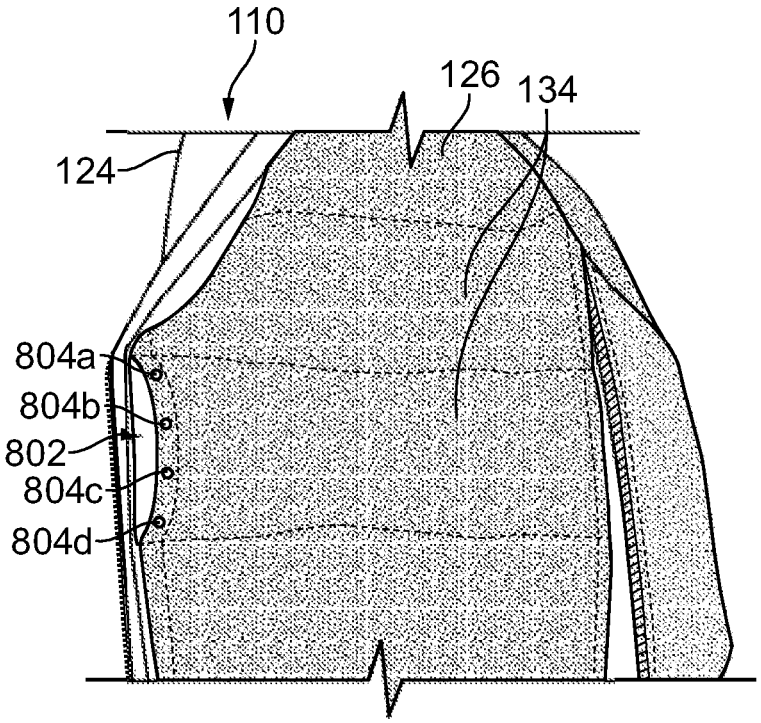
FIG. 8 shows an inner view of the arm sleeve and internal pockets of the garment in one embodiment of the present invention.

Referring now to FIG. 8, the inner view of the arm sleeve 110 of the garment 100 is shown with the attached inner lining 126 such that it forms a series of pockets 134 that rest between the inner portion of the sleeve 110 and the inner lining 126. For perspective, a left-hand inner portion 314 of the sleeve shown. The pockets as shown comprise a plurality of pockets 134 dimensioned to fit heating elements that may be mechanical or electrical in nature as described with FIG. 3.

In this embodiment, each pocket or pouch 306, 308, 310 comprise an additional magnets 804*a*, 804*b*, 804*c* 804*d* (south pole) that open and close each pouch 316*a*, 316*b* and 316*c* to hold the heating elements inside the pockets during treatment while also being configured to allow the user or clinician to easily input and remove the heating elements.

Figure 9:
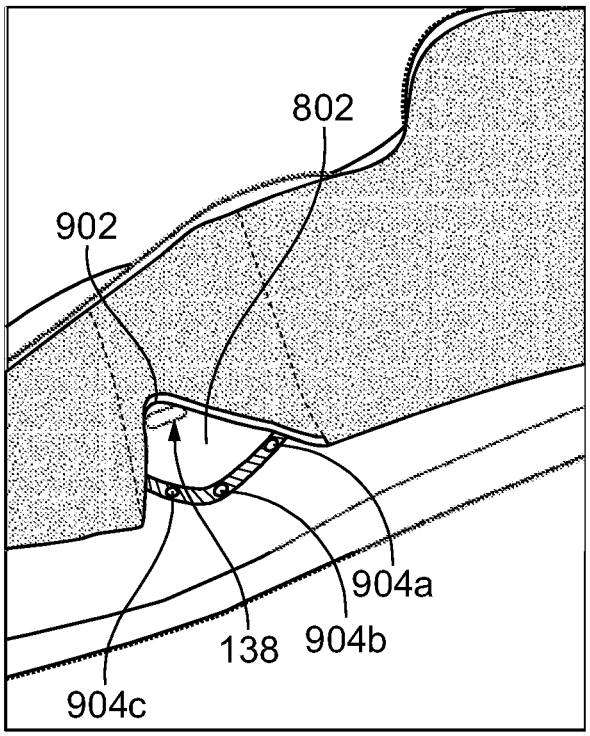
FIG. 9 shows a perspective view of the arm sleeve and internal pocket in the open position in one embodiment of the present invention.

Referring now to FIG. 9, a perspective view of the arm sleeve (108, 110), inner sleeve 126, and pockets 306, 308 and 310 shown in the open position is shown. As shown, pocket 310 is shown in the open position so that the user or the clinician can either put in or remove heating elements which may comprise magnets 904*a*, 904*b*, 904*c* (north pole), hold the heating elements 902 inside the pockets during treatment while also being configured to allow the user or clinician to easily input and remove the heating elements 902.

Figure 10:
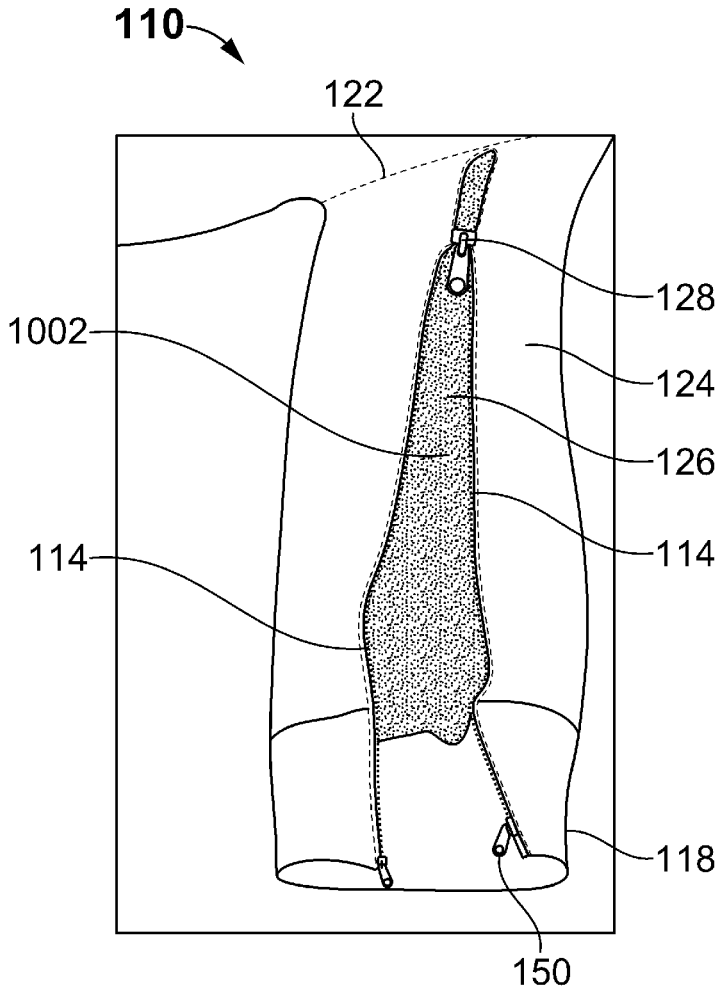
FIG. 10 shows a perspective view of the arm sleeve in which the inner layer and outer layer open together in one embodiment of the present invention.

Referring now to FIG. 10, an embodiment is shown in which the arm sleeve 110 has an outer surface 124 and an inner lining 126 coupled to an inner surface 202 of the sleeve (via sewing or other attachment) in its entirety so that there are no ports and no heat escapes through any port. In this way, an IV tube comes out of the cuff of the garment rather than the port.

Figure 11:
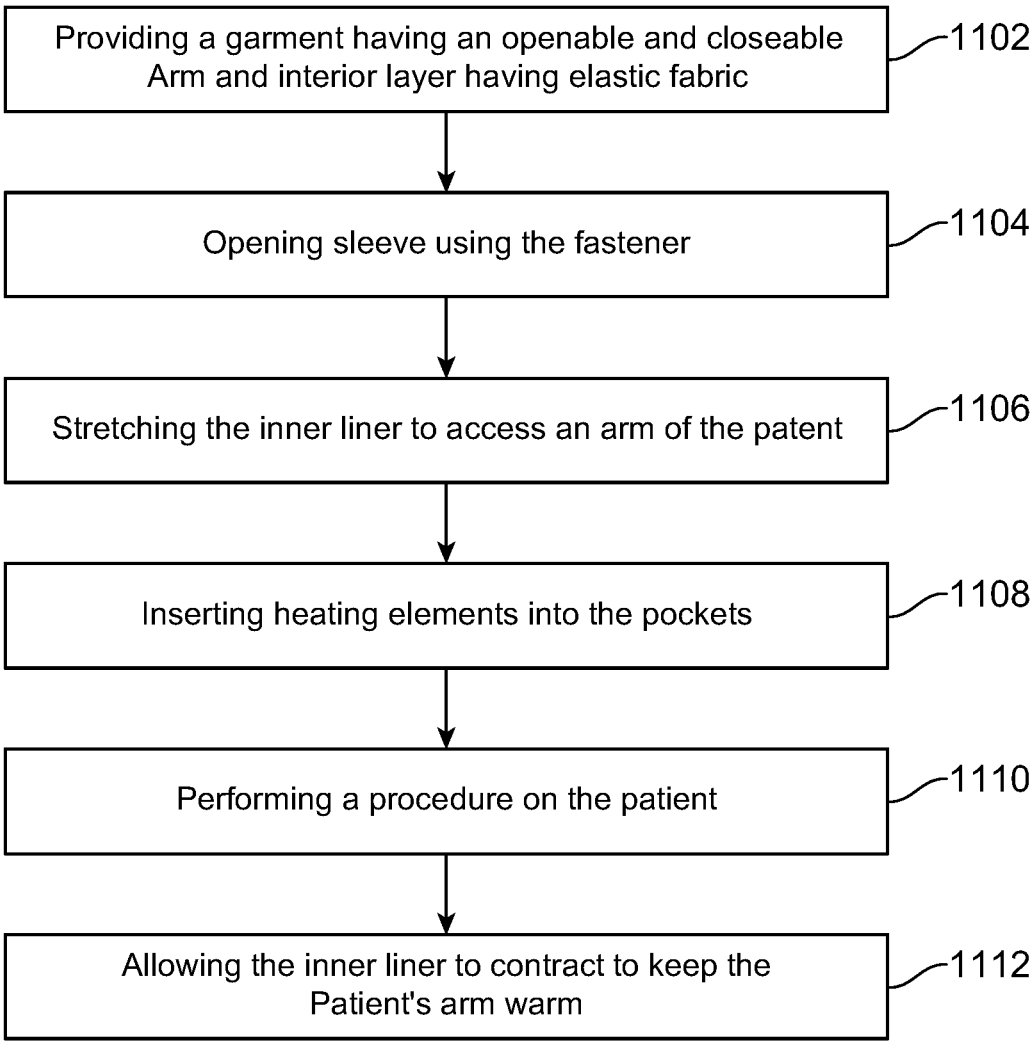
FIG. 11 shows a step-wise diagram for a method for accessing the arm of a patient in one embodiment of the present invention.

Referring now to FIG. 11, In embodiments, a method for accessing an arm of a person receiving treatment is provided. The method comprises providing a garment comprising a body portion configured to cover the patient's upper body, an openable and closeable/resealable sleeve coupled to the body portion, wherein the sleeve has an outer surface and an inner surface each made of a first material, wherein the arm sleeves are configured to cover an arm of the patient, a fastener coupled to the sleeve and configured to open and close the sleeve, wherein an open configuration is a treatment position, an inner lining attached to the inner surface of the sleeve, wherein the inner lining is made of a second material that has a higher elasticity than the first material, and wherein the inner lining is configured to further cover the arm of the patient, and a series of pockets disposed on the inner lining, wherein at least one of the series of pockets are configured to hold a heating element to keep the patient's arms warm while in the treatment position step 1102, opening sleeve using the fastener step 1104, stretching the inner liner to access an arm of the patient step 1106, inserting heating elements into the pockets step 1108, performing a procedure on the patient step 1108, allowing the inner liner to contract to keep the patient's arm warm step 1110.

In operation, the arm sleeves (108 and 110) may completely open up to expose the patient or user's arm and then close up again after the treatment is complete or when desired. The tubes or wires that are a part of the treatment can either go out of the zipper or double closure or down the sleeve (108 and 110) and exit near the hand. In one embodiment, the double closure allows the tubes or wires to exit the garment at the most optimal point based on their placement.

Advantageously, the garment of the present invention helps keep patients warm and keeps their arms covered while receiving intravenous treatments and therapies. While receiving treatment or therapies, the patient may keep their garment on, as the arm sleeves open to expose the arm for the medical professional to insert the IV or attach the medical device (e.g. tube). In addition, an optional warming component may be used in the garment that will help to warm up the fluid as it is put into the patient or user's body. The garment is used to warm the arms more than the rest of the patient or user's body, and it may also be worn for daily use without utilizing the special purpose-built components.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A garment for a patient receiving treatment, the garment comprising:

a body portion configured to cover the patient's upper body;

an openable and closeable sleeve coupled to the body portion, wherein the sleeve has an outer surface and an inner surface each made of a first material, wherein the sleeve is configured to cover an arm of the patient;

a fastener coupled to the sleeve and configured to open and close the sleeve to form an opening, wherein an open configuration and a partially closed configuration is a treatment position;

an inner lining attached to the inner surface of the sleeve, wherein the inner lining is made of a second material, and wherein the inner lining is configured to further cover the arm of the patient, wherein the inner lining comprises multiple access ports along the sleeve for infusion of tubes or wires; and a series of pockets disposed on the inner lining, wherein at least one of the series of pockets are configured to hold a heating element to keep the patient's arms warm while in the treatment position.

2. The garment of claim 1, wherein the second material has a higher elasticity than the first material, and wherein the second material is dimensioned and configured so that the inner lining diametrically expands when in the treatment position, wherein the second material comprises a predetermined additional amount of material relative the sleeve to allow for the diametric expansion of the sleeve.

3. The garment of claim 1, wherein the opening extends vertically an entire length of the sleeve from an outer bottom cuff to a shoulder line of the garment.

4. The garment of claim 1, wherein the heating element is mechanical or electrical.

5. The garment of claim 1, wherein the fastener is a two-way zipper comprising a top and bottom zipper configured to allow the user to form a port between the two zippers.

6. The garment of claim 1, wherein the openable and closeable sleeve is configured to allow the inner lining to be fully exposed so that the clinician can access an arm of the patient, wherein the second material is an elastic thermal fabric.

7. The garment of claim 1, wherein each pocket comprises a closure mechanism, wherein the closure mechanism comprises a flap to hold the heating element inside the pocket during treatment.

8. The garment of claim 1, wherein the fastener comprises a series of magnets located proximate an opening portion of the sleeve and are configured to allow the user to open and close the sleeve.

9. The garment of claim 1, further comprising a microcontroller located in the body portion of the garment and being communicably coupled to the heating element.

10. The garment of claim 9, wherein the microcontroller is configured to automatically turn the heating element on when either of the sleeves are in the open position based on a signal from a sleeve sensor.

11. A method for accessing an arm of a patient receiving treatment, the method comprising:

providing a garment comprising:

a body portion configured to cover the patient's upper body;

an openable and closeable sleeve coupled to the body portion, wherein the sleeve has an outer surface and an inner surface each made of a first material, wherein the sleeve is configured to cover an arm of the patient;

a fastener coupled to the sleeve to form an opening and configured to open and close the sleeve, wherein an open configuration is a treatment position;

an inner lining attached to the inner surface of the sleeve, wherein the inner lining is made of a second material and wherein the inner lining is configured to further cover the arm of the patient wherein the inner lining comprises multiple access ports along the sleeve for infusion of tubes or wires; and a series of pockets disposed on the inner lining, wherein at least one of the series of pockets are configured to hold a heating element to keep the patient's arms warm while in the treatment position;

opening sleeve using the fastener;

stretching the inner lining to access an arm of the patient;

inserting heating elements into the pockets;

performing a procedure on the patient;

allowing the inner lining to contract to keep the patient's arm warm.

12. The method of claim 11, wherein the second material has a higher elasticity than the first material, the second material is dimensioned and configured so that the inner lining diametrically expands when in the treatment position, wherein the second material comprises a predetermined additional amount of material relative the sleeve to allow for the diametric expansion of the sleeve.

13. The method of claim 11, wherein the opening extends vertically an entire length of the sleeve from an outer bottom cuff to a shoulder line of the garment.

14. The method of claim 11, wherein the heating element is mechanical or electrical.

15. The method of claim 11, wherein the fastener is a two-way zipper comprising a top and bottom zipper configured to allow the user to form a port between the two zippers.

16. The method of claim 11, wherein the openable and closeable sleeve is configured to allow the inner lining to be fully exposed so that a clinician can access an arm the patient, wherein the second material is an elastic thermal fabric.

17. The method of claim 11, wherein each pocket comprises a closure mechanism, wherein the closure mechanism comprises a flap to hold the heating elements inside the pocket during treatment.

18. The method of claim 11, wherein the fastener comprises a series of magnets located proximate an opening portion of the sleeve and are configured to allow the user to open and close the sleeve.

19. The method of claim 11, further comprising a microcontroller located in the body portion of the garment and being communicably coupled to the heating elements.

20. The method of claim 19, wherein the microcontroller is configured to automatically turn the heating elements on when either of the sleeves are in the open position based on a signal from a sleeve sensor.

* * * * *